US007871074B2

(12) United States Patent
Yamasaki

(10) Patent No.: US 7,871,074 B2
(45) Date of Patent: Jan. 18, 2011

(54) PAPER CARRYING APPARATUS AND IMAGE FORMING APPARATUS HAVING THE SAME

(75) Inventor: Shinichi Yamasaki, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 313 days.

(21) Appl. No.: 12/208,930

(22) Filed: Sep. 11, 2008

(65) Prior Publication Data

US 2009/0079129 A1 Mar. 26, 2009

(30) Foreign Application Priority Data

Sep. 20, 2007 (JP) ..... 2007-243786

(51) Int. Cl.
*B65H 7/02* (2006.01)

(52) U.S. Cl. ..... 271/265.01; 271/270; 271/272

(58) Field of Classification Search ..... 271/3.18, 271/3.2, 242, 265.01, 270, 272
See application file for complete search history.

(56) References Cited

U.S. PATENT DOCUMENTS 7,547,016 B2 * 6/2009 Mizuno ..... 271/264
2005/0050423 A1 * 3/2005 Yasukawa et al. ..... 714/742

FOREIGN PATENT DOCUMENTS

| | | | |
|---|---|---|---|
| JP | 04096688 A | * | 3/1992 |
| JP | 11-124255 | | 5/1999 |
| JP | 2000352782 A | * | 12/2000 |
| JP | 2006211879 A | * | 8/2006 |
| JP | 2006-290562 | | 10/2006 |
| JP | 2006290562 A | * | 10/2006 |
| JP | 2007127966 A | * | 5/2007 |

* cited by examiner

*Primary Examiner*—Stefanos Karmis
*Assistant Examiner*—Jeremy Severson
(74) *Attorney, Agent, or Firm*—David G. Conlin; Steven M. Jensen; Edwards Angell Palmer & Dodge LLP

(57) ABSTRACT

The paper carrying apparatus includes a first paper carrying mechanism (first carrying mechanism), a second paper carrying mechanism (second carrying mechanism) provided on the downstream of the first carrying mechanism in a carrying direction, an electric motor that drives the first carrying mechanism, a stepping motor that drives the second carrying mechanism, and an acceleration sensor that is a vibration detecting mechanism detecting vibration generated in the rotation shaft of the stepping motor. When the first carrying mechanism and the second carrying mechanism concurrently carry the same paper sheet, the electric motor is controlled in driving velocity based on information of vibration detected by the acceleration sensor at the timing of the rear end of the carried paper sheet passing the first paper carrying mechanism.

10 Claims, 7 Drawing Sheets

NORMAL

WEAR-OUT

PAPER CARRYING APPARATUS AND IMAGE FORMING APPARATUS HAVING THE SAME

CROSS-NOTING PARAGRAPH

This Nonprovisional application claims priority under 35 U.S.C. §119 (a) on Patent Application No. 2007-243786 filed in JAPAN on Sep. 20, 2007, the entire contents of which are hereby incorporated herein by references.

FIELD OF THE INVENTION

The present invention relates to a paper carrying apparatus used in an image forming apparatus and an image forming apparatus having the paper carrying apparatus.

BACKGROUND OF THE INVENTION

An image forming apparatus having a copier function and a printer function includes a paper feeding portion that stacks and contains paper sheets (sheets) used for forming images, a transferring portion that transfers a toner image formed on a photoconductor drum to a paper sheet, and a paper carrying apparatus for carrying paper sheets from the paper feeding potion to the transferring portion.

The paper carrying apparatus includes a plurality of sheet carrying mechanisms (roller pairs) capable of pinching and sending out paper sheets, which are located at predetermined intervals along a paper carrying path, and carries a paper sheet by relaying a paper sheet from the roller pair to the next pair. The paper carrying apparatus causes the upstream roller pair and the downstream roller pair to operate at the same paper carrying velocity to smoothly carry paper sheets.

In an image forming apparatus disclosed in Japanese Laid-Open Patent Publication No. 11-124255, a stepping motor is used to drive resist rollers, which are roller pairs for supplying paper sheets to the transferring portion.

It is assumed here that a stepping motor is used to drive the downstream roller pair and that a circumferential velocity (paper carrying velocity) of the upstream roller pair is reduced since a roller radius of the upstream roller pair is reduced due to the worn-out with the passage of time. In this case, while the upstream roller pair and the downstream roller pair carry the same paper sheet, the paper sheet is stretched by the both roller pairs, and when the rear end of the paper sheet subsequently passes through the upstream roller pair, the load torque for the downstream roller pair is abruptly reduced, and there's a fear that the stepping motor driving the downstream roller pair steps out or stops.

If the motor stops while carrying a paper sheets, this is determined as jamming, resulting in turning-off of a drive current to a drive source of the entire image forming apparatus. Although the normal operation may be performed after the jamming disposal operation if the drive current is resupplied to the apparatus (the apparatus is restarted), the jamming disposal operation must be performed for the paper sheet that was halfway carried.

SUMMARY OF THE INVENTION

It is therefore an object of the present invention to provide a paper carrying apparatus having a plurality of paper carrying mechanisms carrying paper sheets, using a stepping motor for driving a downstream paper carrying mechanism, and capable of preventing step-out of the stepping motor to prevent occurrence of jamming, and an image forming apparatus including the paper carrying apparatus.

Another object of the present invention is to provide a paper carrying apparatus which comprises a first paper carrying mechanism; a second paper carrying mechanism located on the downstream of the first paper carrying mechanism in a carrying direction; an electric motor that drives the first paper carrying mechanism; a stepping motor that drives the second paper carrying mechanism; and a vibration detecting mechanism that detects vibration generated in a rotation shaft of the stepping motor, and in which the driving velocity of the electric motor is controlled based on information of vibration detected by the vibration detecting mechanism at the timing of the rear end of a carried paper sheet passing the first paper carrying mechanism when the first and second paper carrying mechanisms concurrently carry the same paper sheet.

A further object of the present invention is to provide the paper carrying apparatus in which if an amplitude of the vibration of the rotation shaft detected by the vibration detecting mechanism exceeds a first predetermined value, the driving velocity of the electric motor is controlled to be increased.

A further object of the present invention is to provide the paper carrying apparatus in which if the amplitude of the vibration of the rotation shaft detected by the vibration detecting mechanism exceeds a second predetermined value not less than the first predetermined value, a message is displayed to prompt replacement of the first paper carrying mechanism.

A further object of the present invention is to provide the paper carrying apparatus in which if the amplitude of the vibration of the rotation shaft detected by the vibration detecting mechanism exceeds a third predetermined value greater than the second predetermined value, a next paper feeding is prohibited to stop the operation of the apparatus.

A further object of the present invention is to provide the paper carrying apparatus comprising a step-out test mechanism that reduces the driving velocity of the electric motor to cause the stepping motor to be stepped out, and sets the first predetermined value, the second predetermined value, or the third predetermined value based on information of vibration detected by the vibration detecting mechanism at the time of the step-out.

A further object of the present invention is to provide the paper carrying apparatus which comprises a sensor that detects presence of a paper sheet in a carrying path on the upstream side of the first paper carrying mechanism in the carrying direction, and in which the sensor detects passage of the rear end of a paper sheet to acquire the timing of the rear end of the paper sheet passing the first paper carrying mechanism.

A further object of the present invention is to provide the paper carrying apparatus in which the vibration detecting mechanism includes an acceleration sensor and a transmission plate that transmits vibration of the rotation shaft of the stepping motor to the acceleration sensor.

A further object of the present invention is to provide the paper carrying apparatus in which the vibration detecting mechanism includes a rotor laser Doppler vibration sensor that detects vibration of the rotation shaft of the stepping motor.

A further object of the present invention is to provide the paper carrying apparatus in which the electric motor is a stepping motor.

A further object of the present invention is to provide an image forming apparatus comprising the paper carrying apparatus.

PREFERRED EMBODIMENTS OF THE INVENTION

A paper carrying apparatus of the present invention is applicable to an image forming apparatus such as a multifunctional peripheral (MPF) including a copier function and a printer function.

Figure 1:
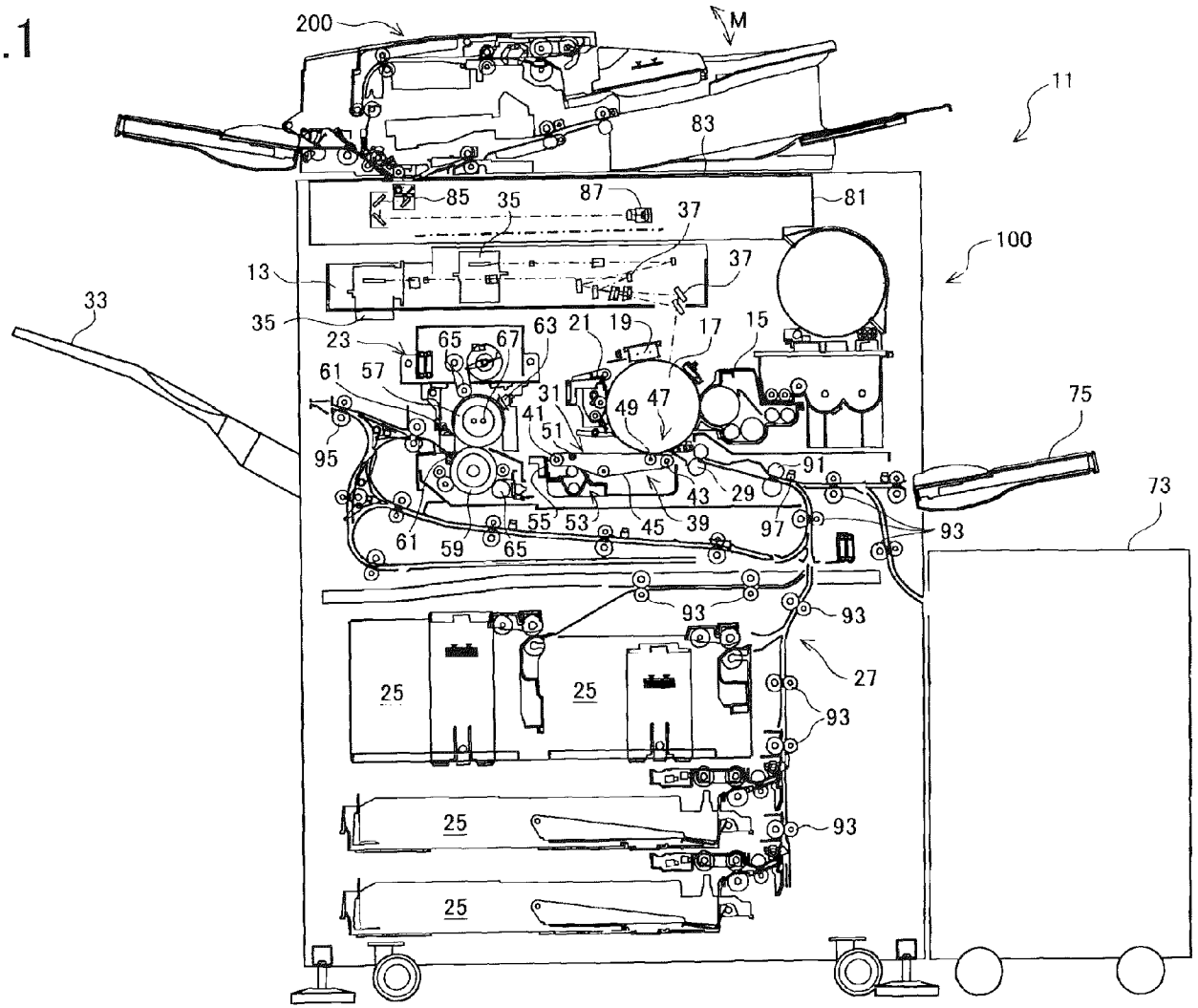
FIG. 1 is an explanatory view of an example of a configuration of an image forming apparatus to which a paper carrying apparatus of the present invention is applied.

FIG. 1 is an explanatory view of an example of a configuration of an image forming apparatus to which a paper carrying apparatus of the present invention is applied. Only a portion relating to a main part of the present invention will hereinafter be described in the image forming apparatus of FIG. 1. An image forming apparatus (MFP) 11 exemplarily illustrated in FIG. 1 forms a monochrome image on a predetermined recording paper sheet in accordance with image data of a read image or image data received from the outside, and includes an apparatus main body 100 and an automatic document processing apparatus 200.

The automatic document processing apparatus 200 automatically carries a document onto a document platen 83 on the upper part of the apparatus main body 100. The automatic document processing apparatus 200 is configured to be rotatable in arrow directions M, and when the document platen 83 is uncovered, a document is placed on it by hand.

A scanner apparatus 81 included in the apparatus main body 100 is used to read a document image, applies light to scan an image of a document set on the clear document platen 83 with a scan unit 85, guides the image through optical components such as mirrors and an imaging lens, and forms the image on a photoelectric transducer 87 to output a document image after conversion into electric signals. A document reading device comprises the scanner apparatus 81 and the automatic document processing apparatus 200.

An electrifier 19 of the apparatus main body 100 of the MFP 11 is an electrifying means for uniformly electrifying the surface of the photoconductor drum 17 to a predetermined electric potential.

An exposure unit 13 exposes the photoconductor drum 17 uniformly electrified by the electrifier 19 in accordance with the input or read image data to form an electrostatic latent image on the surface of the photoconductor drum 17 in accordance with the image data.

A developer 15 develops the electrostatic latent image formed on the photoconductor drum 17 with toner. A cleaner unit 21 removes and collects toner remaining on the surface of the photoconductor drum 17 after the development and the image transfer.

The toner developed as an image on the photoconductor drum 17 is transferred by a transferring mechanism (transferring portion) 39 to a paper sheet carried through a paper carrying path 31. A paper with the toner transferred by the transferring mechanism 39 is carried to a fixing unit 23. The fixing unit 23 includes a heating roller 57 and a pressurizing roller 59, causes unfixed toner on the carried paper sheet to be heated and melted due to the temperature of the surface of the heating roller 57, and causes the unfixed toner on the carried paper sheet to be fixed on the paper sheet due to the anchoring effect with a pressurized contact force from the pressurizing roller 59 in a pressurized contact portion (referred to as a fixing nip portion) between the heating roller 57 and the pressurizing roller 59.

Paper feed trays 25 are trays for accumulating the recording paper sheets used for image formation and are disposed on the underside and side walls of an image forming portion in this apparatus. A side of the MFP 11 is provided with a large-capacity paper feed cassette 73 capable of containing a large amount of paper sheets of various types and a manual tray 75 mainly used for printing in nonstandard sizes.

Although the MFP 11 is provided with a discharge tray on the side opposite to the manual tray 75, the discharge tray 33 may be replaced with a post-processing device for discharged paper sheets (e.g., stapling and punching) or a device including a plurality of trays to discharge paper sheets to respective trays depending on the image data.

A paper carrying operation corresponding to the processing mode of the MFP 11 will then be described in detail.

A paper sheet suitable for a printing request is selected from a plurality of the paper feed trays 25 by a microcomputer of a controlling portion that controls the operation of the MFP 11 and is carried to resist rollers 29 by carrying rollers 93 and pre-resist rollers 91 in the carrying path. The pre-resist rollers 91 are carrying rollers disposed on the upstream side of the resist rollers 29 and is located at a distance equal to or less than a length of the paper sheet from the resist rollers 29. The resist rollers 29 are used for adjusting the timing of sending the paper sheet to the paper carrying path 31.

A sensor 97 for detecting a paper sheet on a paper carrying path 27 is provided on the upstream side of the pre-resist rollers 91, and a sensor (not shown) for detecting a paper sheet is provided between the pre-resist rollers 91 and the resist rollers 29. The microcomputer of the controlling unit controls the resist rollers 29, the pre-resist rollers 91, etc., based on detection results of these sensors.

The paper sheet is temporarily stopped when arriving at the resist rollers 29 under the control of the microcomputer. The microcomputer controls to rotate the resist rollers 29 (and the pre-resist rollers 91) again at the timing synchronizing the front edge of the paper sheet with the image information on the photoconductor drum 17 to carry the sheet to the transferring mechanism 39. The transferring mechanism 39 transfers toner corresponding to the image information onto the sheet and the sheet is guided to the fixing unit 23 to fix the transferred toner onto the sheet. The sheet is then discharged to the discharge tray 33 through discharge rollers 95.

Figure 2A:
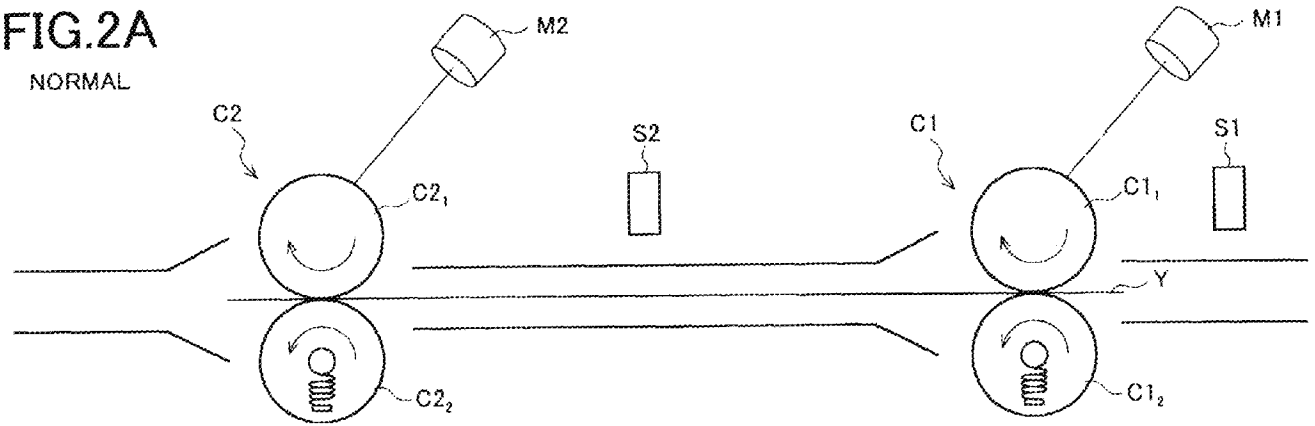
FIGS. 2A and 2B are explanatory views of torque applied to a second carrying mechanism C2 if a first carrying mechanism C1 is worn out when the first and second carrying mechanisms C1 and C2 carries the same paper sheet Y in the paper carrying apparatus of the present invention.
Figure 2B:
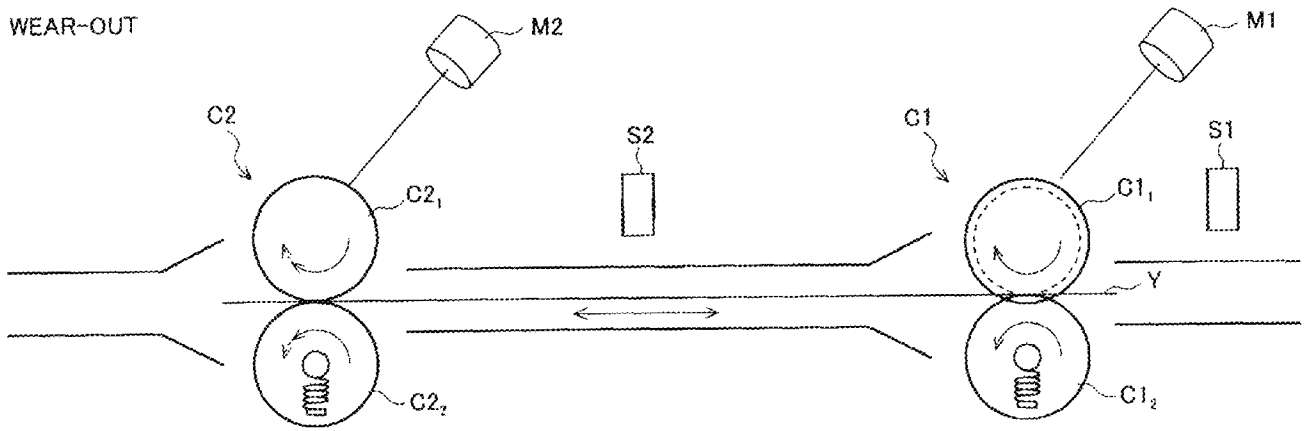

As shown in FIGS. 2A and 2B, a paper carrying apparatus of the present invention applicable to the above image forming apparatus includes a first paper carrying mechanism (hereinafter, first carrying mechanism) C1 carrying a paper sheet, and a second paper carrying mechanism (hereinafter, second carrying mechanism) C2 carrying a paper sheet and located on the downstream of the first carrying mechanism C1 in the carrying direction. The second carrying mechanism C2 is located at a distance equal to or less than a length of the paper sheet from the first carrying mechanism C1. The paper carrying apparatus includes a first paper sheet detection sensor S1 that detects presence of a paper sheet in the carrying path on the upstream of the first carrying mechanism C1 and a second paper sheet detection sensor S2 that detects presence of a paper sheet in the carrying path between the first carrying mechanism C1 and the second carrying mechanism C2. The first carrying mechanism C1 and the second carrying mechanism C2 correspond to the pre-resist rollers 91 and the resist rollers 29, respectively, of FIG. 1, for example. The first paper sheet detection sensor S1 and the second paper sheet detection sensor S2 correspond to the sensor 97 and the sensor disposed between the pre-resist rollers 91 and the resist rollers 29, respectively.

The first carrying mechanism C1 and the second carrying mechanism C2 have an electric motor M1 and a stepping motor M2, respectively, as drive sources. The electric motor M1 may be a stepping motor. The electric motor M1 and the stepping motor M2 are hereinafter referred to as a first motor M1 and a second motor M2, respectively.

The first carrying mechanism C1 consists of a first driving roller $C1_1$ driven by the first motor M1 and a first driven roller $C1_2$ biased toward the first driving roller $C1_1$ to form a nip portion pinching a paper sheet. The second carrying mechanism C2 consists of a second driving roller $C2_1$ and a second driven roller $C2_2$ similar to the first driving roller $C1_1$ and the first driven roller $C1_2$, respectively.

At the time of normal carrying while the first carrying mechanism C1 and the second carrying mechanism C2 carry a paper sheet at the same paper carrying velocity, the paper sheet is not stretched between the first carrying mechanism C1 and the second carrying mechanism C2 as shown in FIG. 2A. Therefore, torque is not considerably changes in the second carrying mechanism C2 after the rear end of a paper sheet Y passes the first carrying mechanism C1.

However, for example, if (the first driving roller C1 of) the first carrying mechanism C1 is worn out, since a radius of the first driving roller $C1_1$ is reduced as shown in FIG. 2B, a circumferential velocity of the first carrying mechanism C1 is reduced even when the first driving roller $C1_1$ is rotated by the first motor M1 at the same angular velocity as that in the case of FIG. 2A. Therefore, in this case, when both the first carrying mechanism C1 and the second carrying mechanism C2 carry the same paper sheet Y, the paper sheet Y is stretched by the both carrying mechanisms, and the load torque for the second carrying mechanism C2 is increased as compared to that of the normal operation.

Description will be made of generation of vibration in the second motor M2 (see FIGS. 2A and 2B) driving the second carrying mechanism C2 when the increased load torque is required for the second carrying mechanism C2 due to greater force applied to the paper sheet Y with reference to FIG. 3.

Figure 3:
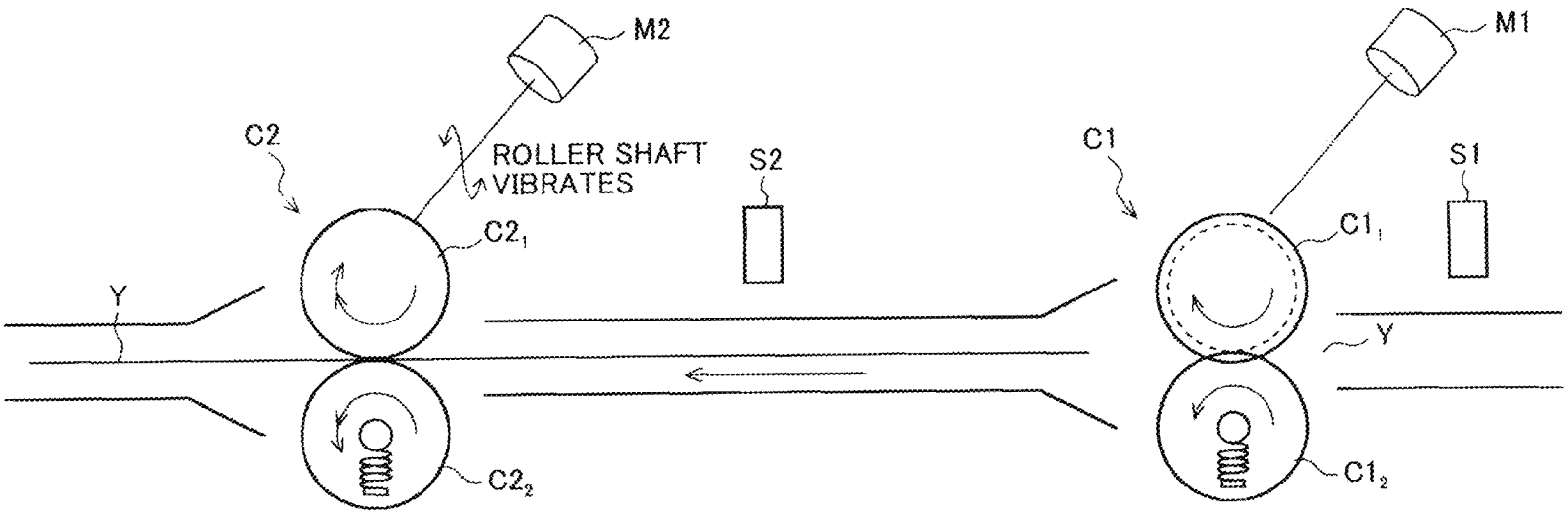
FIG. 3 is an explanatory view of generation of vibration in the second carrying mechanism C2 when increased load torque is required for the second carrying mechanism C2 due to greater force applied to the paper sheet Y.

When the state of FIG. 2B (state of the paper sheet stretched by the both carrying mechanisms) is changed to a state after the rear end of the paper sheet Y passes the first carrying mechanism C1, the load torque for the second carrying mechanism C2 due to the stretching by the first and second carrying mechanisms C1 and C2 is abruptly reduced and the load torque is sharply reduced in the second motor M2 driving the second carrying mechanism C2 as shown in FIG. 3. This sharp reduction of the load torque causes the second motor M2 to vibrate perpendicularly to a rotor shaft thereof (not shown).

At the time of rotation of the stepping motor, the stepping motor is rotated by giving a rotation torque to a magnetic material of the rotor rotation shaft from a magnetic force due to a magnetic field generated by a drive coil of a stator, and if the load torque is sharply reduced, the lead angles are differentiated between the rotor rotation shaft and the magnetic field generated by the drive coil, and the magnetic field generated by the magnetic material of the rotor rotation shaft and the magnetic field generated by drive coil repel each other. Due to this repulsive force, etc., vibration is generated perpendicularly to the shaft.

If the change in the load torque becomes greater, the vibration is increased, resulting in step-out of the stepping motor.

The paper carrying apparatus of the present invention detects the generation of vibration in the second carrying mechanism C2 (second motor M2) to determine that the circumferential velocity of the first driving roller $C1_1$ is reduced due to wearing of the first carrying mechanism C1 and can prevent the step-out of the second motor M2 by controlling the first motor M1 such that the circumferential velocity of the first driving roller $C1_1$ is increased to eliminate the change in the load torque of the second carrying mechanism C2.

Figure 4A:
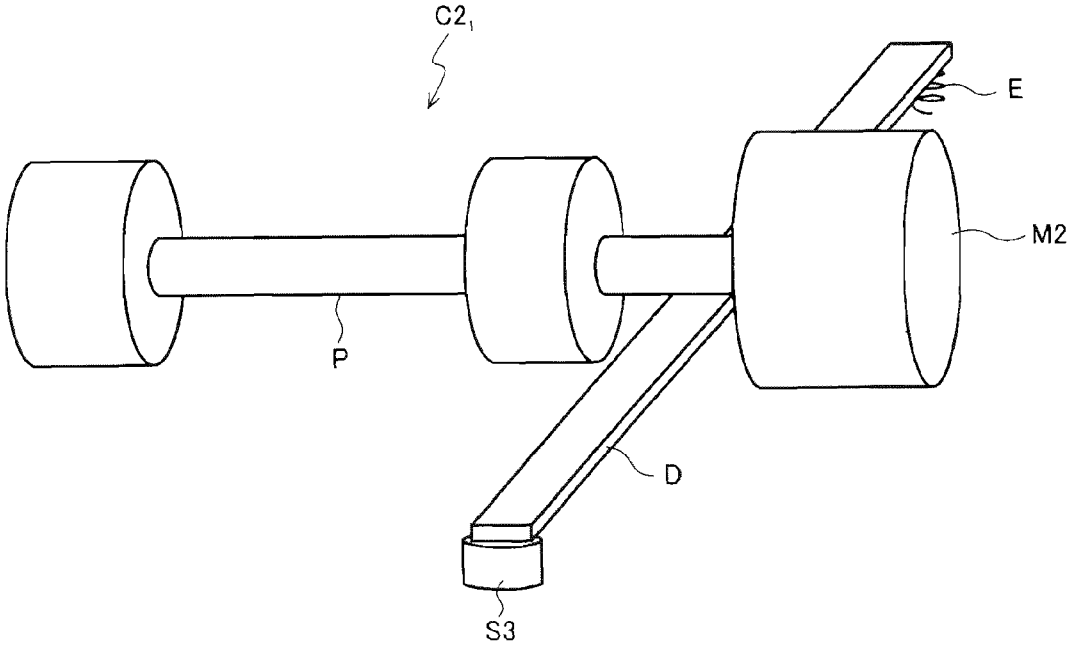
FIGS. 4A and 4B depict a configuration of detecting vibration of a stepping motor M2 driving a second driving roller $C2_1$ of the second carrying mechanism C2 in the paper carrying apparatus of the present invention.
Figure 4B:
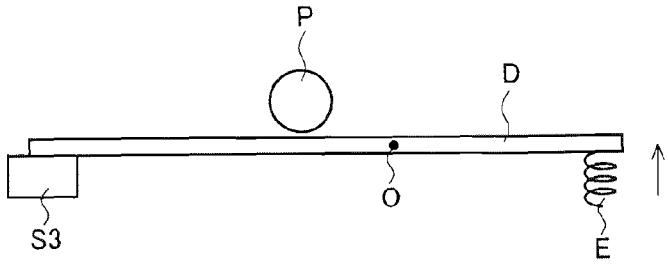

FIGS. 4A and 4B depict a configuration of detecting vibration of the second motor M2 driving the second driving roller $C2_1$ of the second carrying mechanism C2 in the paper carrying apparatus of the present invention.

The paper carrying apparatus of the present invention includes an acceleration sensor S3 that is a vibration detector detecting vibration of the rotation shaft of the second motor M2 driving the second driving roller $C2_1$ and a transmitting plate D that transmits the vibration of the rotation shaft of the second motor M2 (second driving roller $C2_1$) to the acceleration sensor S3, as shown in FIG. 4A.

The second driving roller $C2_1$ has a support shaft P supported by a housing of the paper carrying apparatus (such as housing of the apparatus main body 100 of the MFP 11 of FIG. 1), and this support shaft P is directly coupled to a rotor shaft (not shown) of the second motor M2 and is supported such that the second driving roller $C2_1$ may be rotated when the rotor shaft is rotated. The transmitting plate D is disposed oppositely to the support shaft P with regard to the vibration direction such that the vibration may be transmitted to the acceleration sensor S3 when the shaft of the rotor of the second motor M2 is vibrated perpendicularly to the shaft.

The transmitting plate D is supported with a shaft by the housing of the paper carrying apparatus as shown in FIG. 4B, for example, and enables seesaw motion around this support shaft O acting as a pivot (fulcrum). With respect to the pivot, the acceleration sensor S3 is provided on one side and an elastic member (spring) E is disposed on the other side. Both the acceleration sensor S3 and spring E contact with the under part of the transmitting plate D. The acceleration sensor S3 is pressed by one end of the transmitting plate D since the spring E upwardly biases the other end of the transmitting plate D.

The support shaft P of the second carrying mechanism C2 directly coupled to the shaft of the second motor M2 is located at a position on the upper side of the transmitting plate D between the position of the fulcrum O of the seesaw motion and the position contacting with the acceleration sensor S3. A slight gap is provided between the transmitting plate D and the support shaft P, and if the support shaft P is vibrated greater than the gap, the vibration is transmitted to the acceleration sensor S3.

The acceleration sensor S3 includes a piezoelectric element. Therefore, when the second carrying mechanism C2 is vibrated in a certain amplitude of vibration or more, the acceleration sensor S3 is capable of detecting the amplitude of the vibration as a pressure pressing the upper surface of the acceleration sensor S3 and outputs a voltage proportional to the amplitude of the vibration.

Based on the detection output of the acceleration sensor S3 making up a vibration detecting mechanism, for example, if the output voltage exceeds a first predetermined value, i.e., if the vibration of the second carrying mechanism C2 exceeds the first predetermined value, the paper carrying apparatus of the present invention controls a driving velocity of the first motor M1 such that the paper carrying velocity of the first carrying mechanism C1 is increased.

Figure 5:
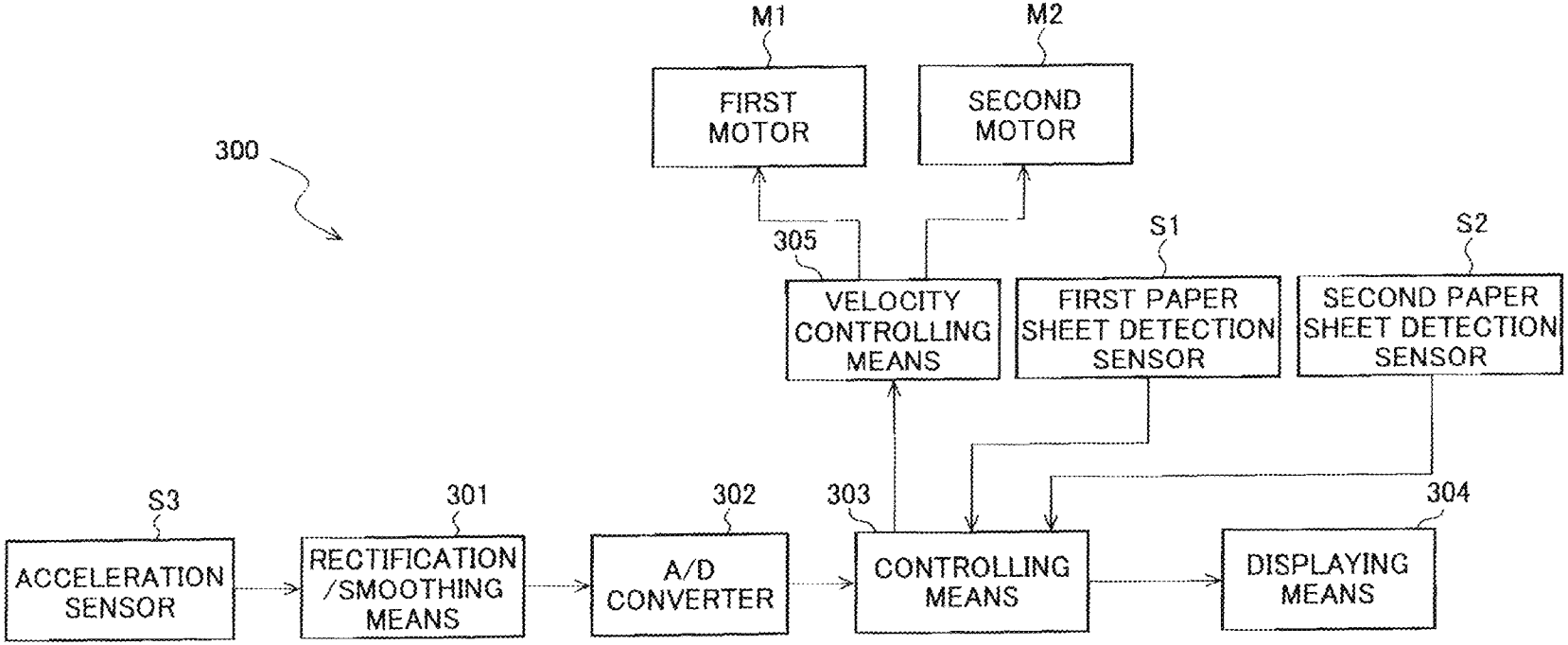
FIG. 5 is an explanatory block diagram of the paper carrying apparatus according to one embodiment of the present invention.

FIG. 5 is an explanatory block diagram of the paper carrying apparatus according to one embodiment of the present invention.

In the paper carrying apparatus of the present invention, the first motor M1 and the second motor M2 consisting of stepping motors drive the first carrying mechanism C1 and the second carrying mechanism C2 (see FIGS. 2A and 2B), respectively. The acceleration sensor S3 detects vibrations generated in the second motor M2. A rectification/smoothing means 301 converts the output (alternating-current voltage) of the acceleration sensor S3 into a direct-current voltage. An A/D converter 302 converts the direct-current voltage converted by the rectification/smoothing means into a digital value.

The first and second paper sheet detection sensors S1 and S2 respectively detect presence of a paper sheet in the upstream paper carrying paths of the first and second carrying mechanisms C1 and C2 in the paper carrying paths within a length of the paper sheet from the respective carrying mechanisms and are made up of reflective optical sensors, for example. A velocity controlling means 305 controls drive pulses given to the first and second motors M1 and M2 based on a velocity signal, etc., output by a controlling means 303 described later. A displaying means 304 is a displaying device such as an LCD display. For example, the displaying means 304 displays a message prompting replacement of the first carrying mechanism C1 if a predetermined value is exceeded by a value of vibration of the second motor M2 based on the information of the vibration detected by the acceleration sensor S3 making up the vibration detecting mechanism.

The controlling means 303 controls portions of a paper carrying apparatus 300 and includes a timer (not shown). The controlling means 303 controls the velocity controlling means to increase/decrease the drive pulses given to the first motor M1 and the second motor M2 based on the detection results of the first paper sheet detection sensor S1 and/or the second paper sheet detection sensor S2 and the detection result of the acceleration sensor S3. The controlling means 303 causes the displaying means 304 to display various messages based on the detection result of the acceleration sensor S3.

For example, the vibration detecting mechanism of the present invention includes the acceleration sensor S3, and the rectification/smoothing means 301, the A/D converter 302, and the controlling means 303 are included in the controlling portion of the MFP 11 of FIG. 1, for example. The controlling portion of the MFP 11 controls the operations of the MFP 11 and is made up of a microcomputer, a ROM having stored thereon a control program that is a processing procedure executed by the microcomputer, a RAM providing a work area for operations, a nonvolatile memory backing up and retaining data necessary for control, input circuits being input the input signals from sensors and switches and including an input buffer and an A/D conversion circuit, and output circuits including drivers driving loads such as motors, solenoids, and lamps, for example.

However, the vibration detecting mechanism of the present invention may be configured to include the rectification/smoothing means 301 and/or the A/D converter 302. The velocity controlling means 305 may be included in the controlling position of the MFP 11 of FIG. 1, and the first motor M1 and the second motor M2 may be configured to include respective means similar to the velocity controlling means 305.

The displaying means 304 may be separated from the paper carrying apparatus 300.

For example, the paper carrying apparatus 300 consisting of the above constituent elements controls the velocity controlling means 305 to increase a driving velocity of the first motor M1 if the first predetermined value is exceeded by a value of vibration based on the information of the vibration detected by the acceleration sensor S3 acting as a vibration detector. For example, if the second predetermined value is exceeded by a value of vibration based on the information of the vibration detected by the acceleration sensor S3 acting as a vibration detector, the paper carrying apparatus 300 controls and causes the displaying means 304 to display a message prompting replacement of the first carrying mechanism C1.

The first and second predetermined values may be the same value and, in the following example, it is assumed that the first and second predetermined values are the same value and the second predetermined value is also referred to as the first predetermined value for convenience of explanation.

Figure 6:
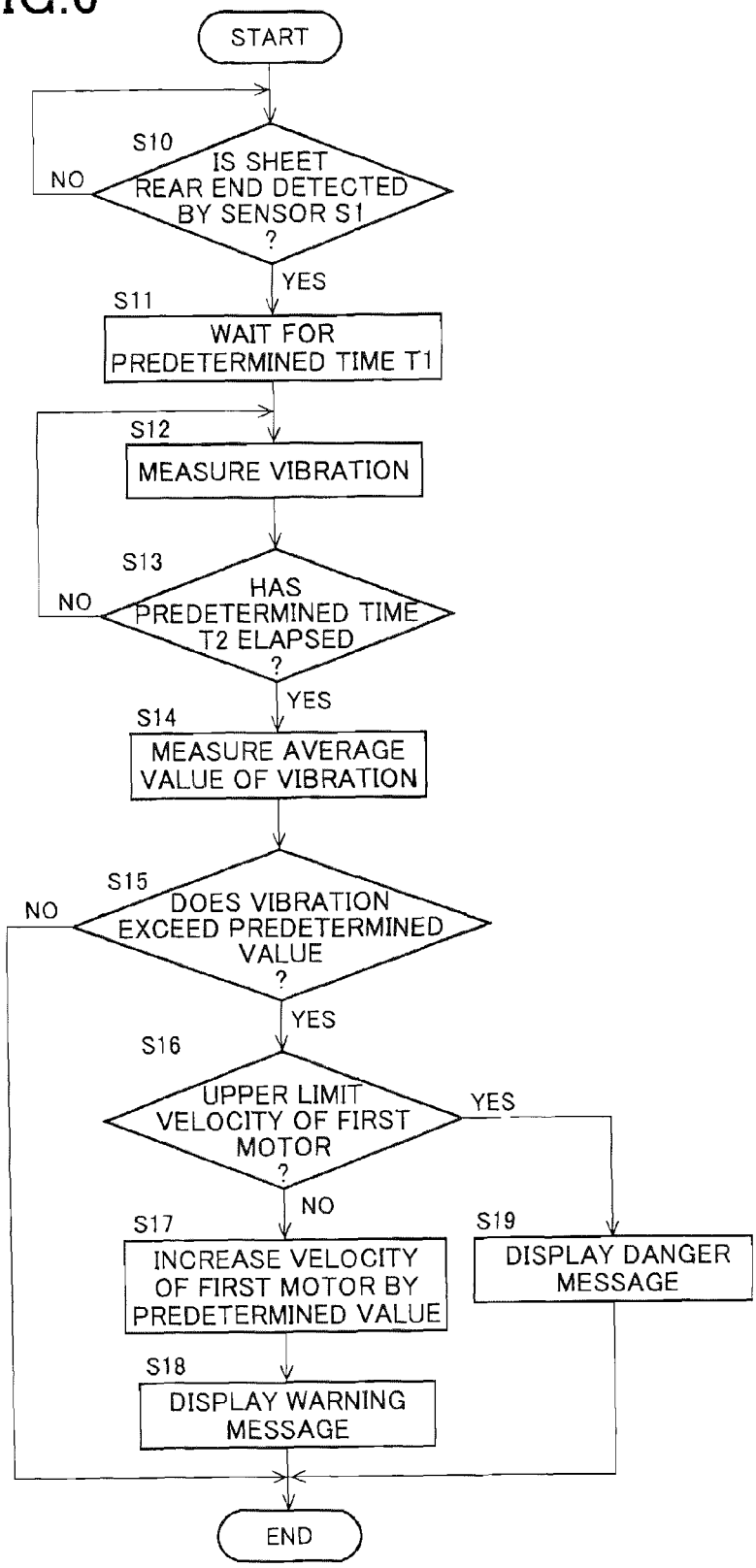
FIG. 6 is an explanatory flowchart of an example of the circumferential velocity changing processing at the time of carrying a paper sheet in the paper carrying apparatus.

FIG. 6 is an explanatory flowchart of an example of a circumferential velocity changing process at the time of carrying a paper sheet in the paper carrying apparatus.

The controlling means 303 waits for the first paper sheet detection sensor S1 (hereinafter, sensor S1) to detect the rear end of a paper sheet (i.e., until the output from the sensor S1 indicates that "no paper sheet exists" after indicating that "a paper sheet exists"). When the rear end of a paper sheet is detected (step S10, YES), the waiting state is continued during a predetermined time T1 until the rear end of a paper sheet comes close to the nip portion of the first carrying mechanism C1 from the position of the sensor S1 (step S11). The predetermined time T1 is calculated by the controlling means 303 based on the driving velocity of the first motor M1, for example. After the predetermined time T1 has elapsed, vibration information indicating the amplitude of vibration is acquired from the acceleration sensor S3 through the rectification/smoothing means 301 and the A/D converter 302 (i.e., vibration is measured with the use of the acceleration sensor S3) (step S12).

The controlling means 303 determines whether a predetermined time T2 has elapsed which corresponds to timings before and after the rear end of the paper sheet passes the nip portion of the first carrying mechanism C1 (step S13), and if not elapsed (in the case of NO), the procedure goes back to step S12 to continue the measurement of vibration. Therefore, vibration is measured until the predetermined time T2 elapses. After the predetermined time T2 elapsed (step S13, YES), the controlling means 303 calculates an average value of (measurement values of) the vibration measured during the predetermined time T2 (step S14) and acquires the average value as the measurement value. Since the vibration is measured in a short period before and after the rear end of the paper sheet passes the nip portion with the use of the sensor S1, the vibration value may be constrained from being erroneously measured due to effect of noise. The predetermined time T2 may be calculated based on the driving velocity of the first motor M1.

The controlling means 303 then determines whether the measurement value of the vibration of the second motor M2 exceeds the first predetermined value based on the acquired measurement value (step S15). If the first predetermined value is not exceeded (in the case of NO), the processing is simply terminated, and if the first predetermined value is exceeded (in the case of YES), it is determined whether the driving velocity currently set for the first motor M1 is the drivable upper limit velocity (step S16). If the velocity is not the upper limit velocity (in the case of NO), the velocity of the first motor M1 is increased by a predetermined value (step S17). In this case, a warning message is displayed on the displaying unit 304 to prompt the replacement of rollers of the first carrying mechanism C1 (step S18). If the current driving velocity of the first motor M1 is the predetermined upper limit velocity (step S16, YES), no adjustment is possible and, therefore, a message (danger message) is displayed to indicate that step-out is unavoidable or that wearing of the first carrying mechanism C1 reaches a limit (step S19).

The controlling means 303 of the paper carrying apparatus 300 of FIG. 5 drives and controls the first motor M1 based on the driving velocity of the first motor M1 set through the above flow.

The predetermined time T1 may be set to be a time until the rear end of a paper sheet passes the nip portion of the first carrying mechanism C1 from the position of the sensor S1, and the vibration information may be acquired after the predetermined time T1 elapsed without setting the predetermined time T2 to acquire the measurement value of the vibration based on the vibration information. In this case, the first predetermined value used in above step S15 may be different from the value of the above example.

With regard to a predetermined value used for determining whether the velocity control is performed at step S15, the predetermined value may preliminarily be set, or the paper carrying apparatus (image forming apparatus) may be configured to include a following step-out test mechanism (mode) to set the predetermined value based on a measurement value acquired in the step-out test mode.

In the step-out test mode, a velocity of the first carrying mechanism C1, i.e., the driving velocity of the first motor M1 is intentionally reduced in steps to generate step-out and a vibration generation amount at the time of generation of step-out (step-out vibration amount) is measured to set a threshold value (the first predetermined value of step S15) of the vibration generation amount for performing the velocity control based on the step-out vibration amount. The threshold value may be set in the step-out test mode before a normal print process, for example, after adjustment by a service person.

Figure 7:
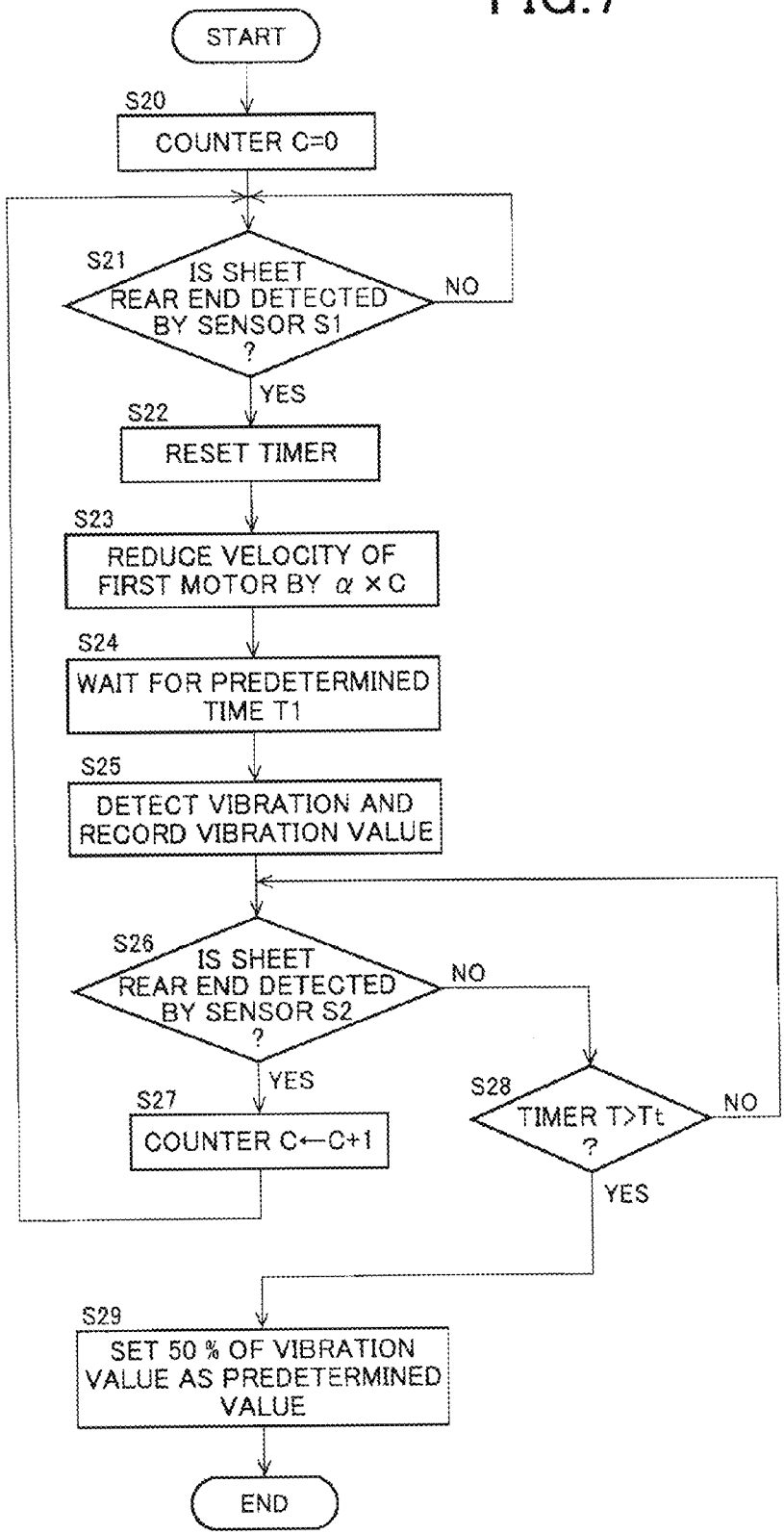
FIG. 7 is an explanatory flowchart of an example of the processing for the step-out test mode in the paper carrying apparatus.

FIG. 7 is an explanatory flowchart of an example of a processing at the time of the step-out test mode in the paper carrying apparatus.

When the step-out test mode is started, the controlling means 303 resets a counter value C of a counter incremented each time one paper sheet is carried in the step-out test mode, i.e., the count value C is set to zero (step S20). The paper carrying operation is started to set the threshold value and the waiting state is continued until the sensor S1 detects the rear end of the paper sheet (i.e., until the rear end of a paper sheet passes the sensor S1). Although the paper carrying operation is the same as the paper carrying operation at the time of normal printing, an image may not be formed on the paper sheet as in the time of printing.

When the rear end of the paper sheet is detected (step S21, YES), the timer is reset (step S22). A value obtained by multiplying the count value C of the counter by a predetermined value a is subtracted from the driving velocity set for the first motor M1 to set a new driving velocity, and the driving velocity of the first motor M1 is reduced by $\alpha \times C$ (step S23).

The waiting state is continued during the predetermined time T1 until the rear end of the paper sheet comes close to the nip portion of the first carrying mechanism C1 from the position of the sensor S1 (step S24). After the predetermined time T1 elapsed, vibration of the second motor M2 is detected with the use of the acceleration sensor S3 and recorded as a vibration value in the same manner as that the above circumferential velocity changing processing (step S25). The waiting state is subsequently continued until the rear end of the paper sheet is detected by the second paper sheet detection sensor S2 (hereinafter, sensor S2) that detects presence of a paper sheet being carried between the first carrying mechanism C1 and the second carrying mechanism C2.

If the sensor S2 detects the rear end of the paper sheet (step S26, YES), the count value C of the counter is incremented (step S27), and the procedure goes back to step S21 to repeat the above processing. On the other hand, if the paper sheet is not detected even when the waiting state is continued, i.e., if the paper sheet is not detected even when a timer value T of the timer exceeds a predetermined value Tt (step S26, NO and step S28, YES), the vibration value recorded at step S25 is defined as the step-out vibration amount. A value of 50 % of the step-out vibration amount is set as the first predetermined value (threshold value) used for determining whether the velocity control is performed (step S29), and the processing is terminated.

The first threshold value may be set to an appropriate value by measuring the step-out vibration amount and setting the first threshold value based on this step-out vibration amount before the normal printing processing as above.

At the time of the above printing processing (processing as shown in FIG. 6), if the current driving velocity of the first motor M1 is the upper limit velocity, a danger message is displayed and the printing processing is continued without change. However, if the processing is continued without change, the second motor M2 may actually be stepped out and jamming may occur. To prevent the jamming from occurring due to the step-out during the printing operation, a third predetermined value (threshold value) may be set based on the step-out test mode to determine whether the apparatus is actually stopped, and the vibration value of the second motor M2 may continuously be measured during the printing operation after displaying the danger message.

If the vibration value of the second motor M2 during the printing operation comes closer to the third predetermined value (e.g., 90% of the recorded step-out vibration amount), a paper sheet may be prohibited from being newly supplied and all the paper sheets currently carried may be discharged to stop the operation of the apparatus. Since the step-out vibration amount is measured before the normal printing processing, a state immediately before the occurrence of step-out may be detected as above. Therefore, the carrying mechanism may be used as long as possible within a range not causing the occurrence of jamming (i.e., step-out) and the apparatus can be stopped immediately before the step-out occurs.

To detect the vibration of the rotation shaft of the second carrying mechanism C2 (second motor M2) in the above example, the transmission plate D directly contacts with the support shaft supporting the second driving roller $C2_1$ of the second carrying mechanism C2 to transmit the vibration of the rotation shaft (second driving roller $C2_1$) of the second motor M2 to the acceleration sensor S3 in the vibration detecting mechanism. However, in the paper carrying apparatus (image forming apparatus), a noncontact mechanism may be used instead of the above contact vibration detecting mechanism.

The non-contact vibration detecting mechanism may be achieved with the use of a rotor laser Doppler vibration sensor, etc.

The rotor laser Doppler vibration sensor includes, for example, a laser beam source; a splitter that splits a laser beam generated from the laser beam source in two; and a light-transmitting/receiving unit applying one split laser beam to a vibration measurement target and receiving and causing the reflection light reflected thereby to be made incident on a frequency detecting means described later. The rotor laser Doppler vibration sensor further includes a guiding means causing the other split laser beam, i.e., a laser beam having the same frequency as the laser beam applied to the light-transmitting/receiving unit to be made incident on the frequency detecting means described later, and a frequency difference detecting means that detects a difference between the applied frequency and the reflected frequency.

The light-transmitting/receiving unit of the rotor laser Doppler vibration sensor may be disposed near the support shaft (rotation shaft) of the second driving roller $C2_1$ to detect changes in frequency of the reflected light of the applied laser with the frequency difference detecting means. This detection result may be used as vibration information to acquire a measurement value of vibration based on this information.

Since the vibration can be detected without contact in the above configuration, the support shaft of the second driving roller $C2_1$ is not worn due to the contact with the transmission plate, etc.

Since the first carrying mechanism corresponds to the resist rollers and second carrying mechanism corresponds to the pre-resist rollers in the above example, the downstream resist rollers are prevented from stepping out when the pre-resist rollers are seriously worn. However, for example, if any one of the carrying rollers 93 of FIG. 1 is considerably worn, a downstream roller thereof steps out. Therefore, the step-out of the downstream rollers may be prevented by providing vibration sensors on all the rollers including the carrying rollers 93, providing sensors detecting a paper sheet between the rollers, and using these vibration sensors and sensors detecting a paper sheet to control the rotation velocities of the upstream rollers.

According to the present invention, the following effect can be acquired.

Since the present invention includes the above configuration, the step-out may be prevented in the stepping motor that is a drive source of the downstream paper carrying mechanism to prevent occurrence of jamming.

The invention claimed is:

1. A paper carrying apparatus comprising;

a first paper carrying mechanism;

a second paper carrying mechanism located on the downstream of the first paper carrying mechanism in a carrying direction;

an electric motor that drives the first paper carrying mechanism;

a stepping motor that drives the second paper carrying mechanism; and a vibration detecting mechanism that detects vibration generated in a rotation shaft of the stepping motor, a driving velocity of the electric motor being controlled based on information of vibration detected by the vibration detecting mechanism at the timing of the rear end of a carried paper sheet passing the first paper carrying mechanism when the first and second paper carrying mechanisms concurrently carry the same paper sheet.

2. The paper carrying apparatus as defined in claim 1, wherein if an amplitude of the vibration of the rotation shaft detected by the vibration detecting mechanism exceeds a first predetermined value, the driving velocity of the electric motor is controlled to be increased.

3. The paper carrying apparatus as defined in claim 2, wherein if the amplitude of the vibration of the rotation shaft detected by the vibration detecting mechanism exceeds a second predetermined value not less than the first predetermined value, a message is displayed to prompt replacement of the first paper carrying mechanism.

4. The paper carrying apparatus as defined in claim 3, wherein if the amplitude of the vibration of the rotation shaft detected by the vibration detecting mechanism exceeds a third predetermined value greater than the second predetermined value, a next paper feeding is prohibited to stop an operation of the apparatus.

5. The paper carrying apparatus as defined in claim 4, comprising a step-out test mechanism that reduces the driving velocity of the electric motor to cause the stepping motor to be stepped out, the step-out test mechanism setting the first predetermined value, the second predetermined value, or the third predetermined value based on information of vibration detected by the vibration detecting mechanism at the time of the step-out.

6. The paper carrying apparatus as defined in claim 1, comprising a sensor that detects presence of a paper sheet in a carrying path on the upstream side of the first paper carrying mechanism in a carrying direction, wherein the sensor detects passage of the rear end of a paper sheet to acquire the timing of the rear end of the paper sheet passing the first paper carrying mechanism.

7. The paper carrying apparatus as defined in claim 1, wherein the vibration detecting mechanism includes an acceleration sensor and a transmission plate that transmits vibration of the rotation shaft of the stepping motor to the acceleration sensor.

8. The paper carrying apparatus as defined in claim 1, wherein the vibration detecting mechanism includes a rotor laser Doppler vibration sensor that detects vibration of the rotation shaft of the stepping motor.

9. The paper carrying apparatus as defined in claim 1, wherein the electric motor is a stepping motor.

10. An image forming apparatus comprising the paper carrying apparatus as defined in any one of claims 1 to 9.

* * * * *